United States Patent [19]

Koganei

[11] 4,155,144

[45] May 22, 1979

[54] DAMPER DEVICE

[75] Inventor: Tomokichi Koganei, Tokyo, Japan

[73] Assignee: Nikkey Co., Ltd., Japan

[21] Appl. No.: 852,130

[22] Filed: Nov. 16, 1977

[30] Foreign Application Priority Data

Mar. 19, 1977 [JP] Japan ..... 52/33748[U]

[51] Int. Cl.[2] ..... E05F 3/20

[52] U.S. Cl. ..... 16/54; 16/68

[58] Field of Search ..... 16/54, 49, 51, 56, 58, 16/59, 57, 68, 128 R

[56] References Cited

U.S. PATENT DOCUMENTS

| | | | |
|---|---|---|---|
| 1,281,774 | 10/1918 | Franckaerts | 16/54 |
| 1,927,778 | 9/1933 | Hirakawa | 16/54 |
| 2,118,950 | 5/1938 | Stannard | 16/54 |
| 2,164,358 | 7/1939 | Stannard | 16/54 |
| 2,456,537 | 12/1948 | Seaman et al. | 16/54 |
| 2,485,937 | 10/1949 | Swanson | 16/54 |
| 2,490,258 | 12/1949 | Diebel | 16/54 |
| 2,493,116 | 1/1950 | Diebel | 16/54 X |
| 4,068,344 | 1/1978 | Okabe | 16/56 X |

*Primary Examiner*—Werner H. Schroeder
*Assistant Examiner*—Moshe I. Cohen
*Attorney, Agent, or Firm*—Ladas, Parry, Von Gehr, Goldsmith & Deschamps

[57] ABSTRACT

A damper device comprises first and second cylinders which are adjacent and rotatable with respect to each other and have respective hinge pieces, a piston operation member provided in the first and second cylinders in such a manner that it is rotatable with respect to the first cylinder, a piston member to which is fitted a pressure control member which is provided with a multithread section on the outer wall thereof and with a through-hole in the central portion thereof and a through-hole having a check valve, and a plurality of chambers provided in the second cylinder the chambers being divided into the upper and lower chambers by the piston operation member. These chambers are communicated with the through-holes, and a cylinder with a bottom is fitted to the piston member. A plurality of protruded sections, each having predetermined length, width and height, corresponding to the thread grooves of the multi-thread section are formed on the cylinder with the bottom by pressing, so that the rotation around the axis and the vertical movement of the piston member is effected in the cylinder with the bottom.

1 Claim, 4 Drawing Figures

DAMPER DEVICE

BACKGROUND OF THE INVENTION

This invention relates to an improvement of a damper device for gradually closing a door, which is formed integrally with hinge pieces.

The following device for gradually closing a door is known in the art:

The device is provided with the upper and lower cylinders whose adjacent opening ends are rotatable in close contact with each other and which are formed integrally with hinge pieces fixedly secured to the door, respectively, a piston operation member closely fitted into the upper cylinder in such a manner that it is rotatable with respect to the upper cylinder, and a piston member the rotation around its axis and the vertical movement of which are guided by a guide member provided in the cylinder as the piston operation member is rotated. The guide member is provided with a multi-thread section. The piston member is provided with a multi-thread section corresponding to the multi-thread section of the guide member. In the lower cylinder are provided a plurality of chambers which are divided into the upper and lower chambers by the piston operation member. The chambers are filled with viscous fluid such as oil. A through-hole is formed in the axial portion of the piston member so as to communicate with the chambers, and in addition another through-hole provided with a check valve is formed to communicate with the chamber. The rotation and vertical movement of the piston member is controlled by the two through-holes and a rod extended from the piston operation member, which passes through the two through-holes.

In the conventional damper device thus constructed, if in order to vertically move the piston member by the piston operation member which is rotated in association with the swing of the door, the stroke of vertical movement of the piston member is increased with respect to the swinging angle of the door, that is, the rotation angle of the piston operation member, the damping force will be increased. However, in this case, it is necessary to modify the thread section of the guide member in which the piston member is screwed, into a multi-thread structure.

However, the process of forming the thread section on the outer wall of the guide member as a multi-thread section is rather troublesome or difficult. In addition, since viscous fluid such as oil is contained in the guide member, it is necessary that the guide member provided with the multi-thread section is retained at the top, and accordingly it is necessary to weld a separate piece thereto. Thus, the conventional damper device is disadvantageous in that the manufacture there-of is rather difficult, and the manufacturing cost is relatively high, that is, the damper device is not economical in the point of view of manufacture.

SUMMARY OF THE INVENTION

Accordingly, it is an object of this invention to provide a damper device which can be manufactured more readily and at a lower cost than the conventional damper device.

Another object of the invention is to provide a damper device which can be operated more readily than the conventional damper device and in which no maintenance is required.

A further object of the invention is to provide a damper device in which a variety of door closing speeds can be more optionally selected than the conventional damper device, and which is high in reliability and has an excellent damping effect.

A still further object of the invention is to provide a damper device which can be provided with a returning spring operating to close a door or can be used in combination with a door closer.

The foregoing objects and other objects as well as the characteristic features of the present invention will become more apparent from the following detailed description and the appened claims when read in conjunction with the accompanying drawings, in which like parts are designated by like reference numerals or characters.

DETAILED DESCRIPTION OF THE INVENTION

Figure 1:
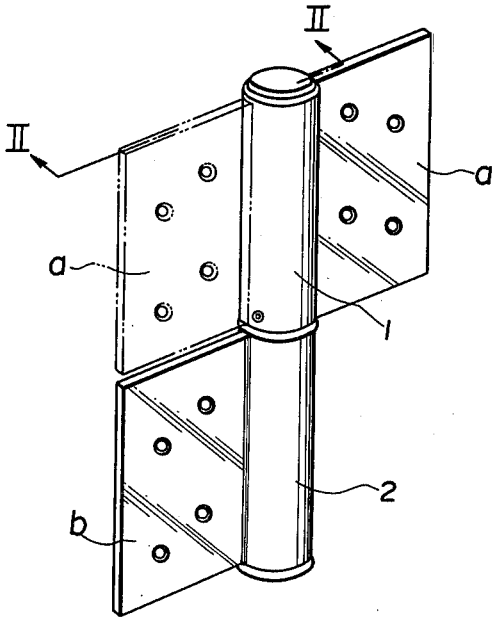
FIG. 1 is a perspective view showing one embodiment of a damper device according to this invention observed when a door is opened as indicated by the solid line.
Figure 2:
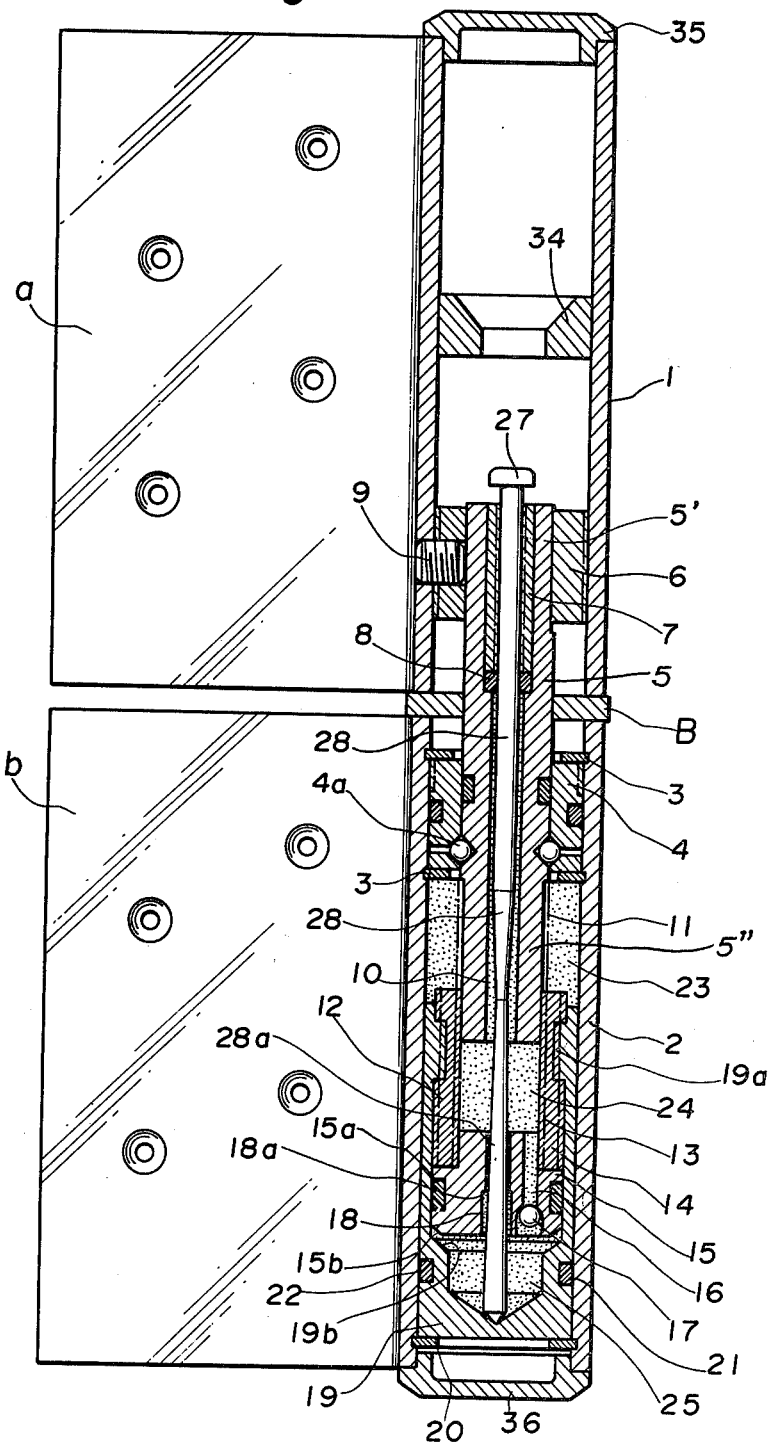
FIG. 2 is a vertical sectional view taken along line II—II in FIG. 1, showing the damper device according to the invention observed when the door is closed as indicated by the one-dot chain line.

Shown in FIGS. 1 and 2 is one preferred example of damper device according to this invention observed when a door provided with the damper device is closed.

A first cylinder 1 formed integrally with a hinge piece a secured to a door (not shown) a second cylinder 2 formed integrally with a hinge piece b secured to a door supporting frame (not shown) are arranged adjacent each other in such a manner that the two cylinders 1 and 2 are rotatable about one and the same axis. The lower opening end of the first cylinder 1 is in close contact with the upper opening end of the second cylinder 2 through a rotation support member B such as a bearing. A piston operation member 5 is incorporated in the upper portion of the second cylinder 2. More specifically, the piston operation member 5 is rotatable in close contact with the inner wall of the second cylinder 2 through a thrust bearing 4 which is secured to the second cylinder 2 by means of a stop ring 3 and is provided with an "O" ring over its outer wall.

The upper portion of this piston operation member 5 is in the form of a semi-cylinder. The semi-cylindrical section 5' is inserted into a cylinder 6 which is screwed into the first cylinder 1. A cylinder 7 having a female-threaded portion is placed over the semi-cylindrical section 5' liquid-tightly by means of an "O" ring 8 provided beneath the cylinder 7. The semi-cylindrical section 5' of the piston operation member 5 is fixedly secured to the first cylinder 1 by means of a retaining screw 9 which is screwed into the first cylinder and the cylinder 6. A through-hole 10 is formed in the piston operation member 5 in such a manner that the through-hole 10 penetrates the axial lower portion 5″ of the piston operation member 5 starting from the lower end of the semi-cylinder section 5′. A serration 11 having a predetermined length is cut in the wall of the axial lower portion 5″. Below the piston operation member 5, a piston member 12 is incorporated in the second cylinder 2. A serration 13 is cut in the inner wall of the piston member 12, while a multi-thread section 14 is formed on the outer wall of the piston member 12. A pressure control member 15 is fitted into the lower end portion of the piston member 12. An "O" ring **15*a* is placed over the pressure control member 15, and a through-hole 16 is formed in the pressure control member 15 along the axial direction in such a manner that the through-hole 16 penetrates the member 15 from the upper end surface to the lower end surface thereof. The diameter of the through-hole 16 is increased at the lower end portion thereof. A steel ball 17 operating as a valve is placed in the enlarged section of the through-hole 16. In addition, a through-hole 18 is formed in the central portion of the pressure control member 15**.

The aforementioned piston member 12 is coupled to a cylinder 19. The cylinder 19 is provided with a protruding section **19*a* on its inner wall which is formed by pressing so that the piston member is fitted thereto so as to be in correspondence to the thread grooves of the multi-thread section 14 provided on the outer wall of the piston member 12. The protruding section 19*a* has three predetermined lengths and widths, forming three threads. The cylinder 19 with the bottom is fixedly secured to the lower portion of the second cylinder 2 by means of a retaining ring 20. A groove 21 is formed in the outer wall of the lower end portion of the cylinder 19, and an "O" ring 22 is inserted in the groove 21, as a result of which the cylinder 19 and the second cylinder 2** are maintained in a liquid-tight condition.

Above and below the piston member 12 there are provided chambers 23 and 24 which are defined by the piston member 12 and the second cylinder 2 and by the piston member 12 and the pressure control member 15, respectively. In addition, a chamber 25 is defined by the pressure control member 15 and the cylinder 19 with the bottom. These chambers are filled with viscous fluid (indicated by dots). The chambers 23 and 24 are communicated with the internal chamber 25 of the cylinder 19 and with the above-described through-holes 10, 16 and 18. A substantially cylindrically shaped control rod 28 is inserted into the through-holes 10 and 18. The control rod 28 is formed integrally with a control screw 27 screwed into the cylinder 7 which is inserted into the semi-cylindrical section 5′ of the above-described piston operation member 5. In addition, the control rod 28 has a sloped surface or tapered surface 28 which is obtained by machining the outer wall of the substantially middle portion of the control screw 27 into the form of a taper.

The through-hole 18 formed in the pressure control member 15 comprises a portion having the same diameter as that of the through-hole 10, and a portion whose diameter is smaller than that of the through-hole 10 and which is extended from the upper end portion of the through-hole to the middle portion of the same. Thus, the pressure control member 15 forms a pressure control valve with the edge **18*a* of the opening of the small diameter portion as a valve seat and with the speed control rod 28 as a valve rod. Accordingly, if the pressure control screw 27 is operated from above the first cylinder 1 so that the valve thus formed is throttled with the tapered portion 28*a* of the control rod 28, the volume of the vicous fluid allowed to flow between the chambers 23 and 24 is controlled, while the flow rate thereof is controlled by the valve 17 in the through-hole 16. This control can be effected as desired by adjusting the above-described pressure control screw 27. The door closing speed can be changed as desired by changing the angle of the slope surface of the tapered portion 28*a*. For instance, it is possible to allow the door to close with a two-step motion if the slope surface of the tapered portion 28*a*** is modified.

Figure 3:
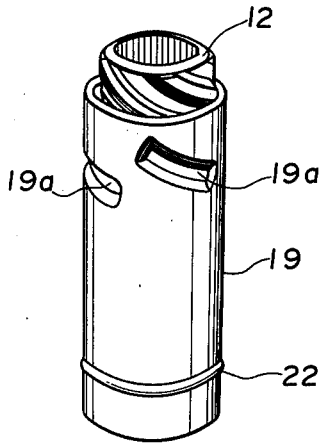
FIG. 3 is a perspective view showing a cylinder with its bottom in which a piston member incorporated in the damper device is screwed.
Figure 4:
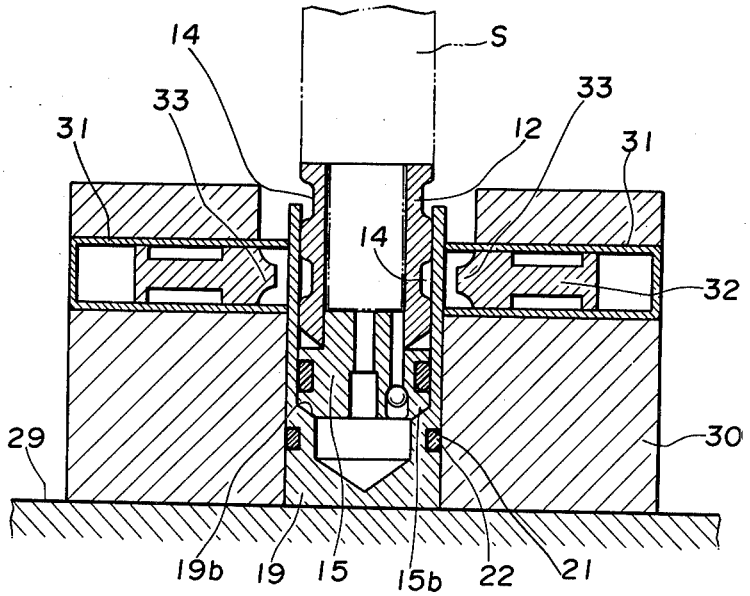
FIG. 4 is a sectional view for a description of the process of forming on the cylinder with the bottom protruded sections corresponding to the thread groove of a multi-thread section provided on the piston member.

The protruded section **19*a* formed on the inner wall of the cylinder 19 (shown in FIG. 3) which is screwed over the piston member 12 is obtained by hydraulic pressing as shown in FIG. 4. More specifically, the cylinder 19 is placed on a stand 29 and is fixed by means of a fixing device 30. Under this condition, the piston member 12 fitted with the pressure control member 15 is inserted into the cylinder 19 until the peripheral bottom portion 15*b* of the pressure control member 15 is abutted against the inner bottom 19*b* of the cylinder 19. The piston member is held so that the piston member 12 is not turned in the cylinder 19 by a suitable fixing jig, for example, an inner retaining jig S inserted into the piston member 12. The use of the inner retaining jig S is useful for readily obtaining alignment and for preventing the distortion of the piston member 12**.

Then, the hydraulic pressure cylinders 31 of the press arranged on the right and left sides of the cylinder 19 are driven. In this case, the top end portion 33 of the ram 32 of the hydraulic pressure cylinder 31 is formed, in advance, into a thread configuration corresponding to the male-threaded portion of the multi-thread section 14 in the piston member. As the hydraulic pressure cylinders 31 apply pressure to the cylinder 19 from both sides thereof, the outer surface of the cylinder 19 is deformed in accordance with the configuration of the male-threaded portion. As a result, the protruded section **19*a* as shown in FIG. 3 is formed on the inner wall of the cylinder in such a manner that is has predetermined length width and height. If the above-described operation is repeated after the hydraulic pressure cylinder 31 are turned or the stand 29 is turned, another protruded section 19*a*′ can be formed at a different position as shown in FIG. 3. In the cylinder 19 with the bottom, two female threads are formed by the protruded sections 19*a* and 19*a*′ on the inner wall of the cylinder 19. After this pressing, the fixing device 30 is moved apart from the cylinder 19, that is, the fixed condition of the cylinder 19 is released, and the piston member 12 in combination with the cylinder 19** is pulled out to be ready for the next position.

The number of threads formed by the protruded sections **19*a* and 19*a*′ provided on the inner wall of the cylinder 19 with the bottom, can be selected as desired by modifying the configurations of the piston member 12 and of the male-thread mold of the ram top end portion 33 within the subject matter of this invention, in the case where the damping force of the damper device provided for the door is preselected according to the weight, shape and kind of the door. In this embodiment, a guide bush 34 for an adjusting tool employed in controlling the pressure control screw 27 of the speed control rod 28 is incorporated in the first cylinder 1; however, it should be noted that the provision of the guide bush 34** is not always necessary. Furthermore, it is possible to insert a returning spring (not shown) adapted to close the door into the first cylinder or into a separate cylinder (not shown) provided at a different position on the door. In addition, it is possible to use a door closer in combination with the damper device according to the invention.

With respect to the door opening degree, if the number of threads is increased in correlation with the protruded section 19*a* formed on the inner wall of the cylinder 19 with the bottom which determines the stroke of the piston member 12 and in addition the piston member 12 is modified in response to the increase of the number of threads, it is, of course, possible to allow the door to turn (open) through more than 180°.

Now, the operation and function of the damper device thus constructed will be described. FIG. 2 shows the damper device observed when the door is closed. As the door thus closed is opened as shown in FIG. 1, the upper cylinder 1 is turned. In synchronization with this turning operation of the upper cylinder 1, the cylinder 6 is turned and the piston operation member 5 is turned in the same direction. Accordingly, the piston member 12 is turned about its central axis through the serration 13 of the piston member 12 which is engaged with the serration 11 provided in the lower portion of the piston operation member 5. As a result, the thread grooves of the multi-thread section 14 are guided along the protruded sections 19*a* and 19*a'* of the cylinder 19, and accordingly the piston member 12 is moved upward in the axial direction. In the upward movement stroke of the piston member 12, the check valve in the pressure control member 15 is operated, that is, the steel ball 17, or the valve body is moved downward so as to open the valve. Accordingly, the viscous fluid is allowed to flow from the chamber 25 through the through-hole 18 to the chamber 24 and from the chamber 24 through the gap between the aforementioned serrations 11 and 13 to the chamber 23. In this case, no pressure control action is effected. The piston member 12 is moved upward while being rotated in this way. Upon arrival at the upper end portion of the cylinder 19, the movement of the piston member 12 is stopped. Thus, the door is opened as shown in FIG. 1 by means of the damper device.

As the door thus opened is closed by the restoring force of the spring (not shown) inserted in the first cylinder or in the cylinder provided at the different position on the door or by the door closing operation of the door closer employed in combination with the damper device according to the invention, the piston operation member 5 is turned in the opposite direction, and the thread grooves of the multi-thread section 14 are guided along the protruded sections 19*a* and 19*a'* of the cylinder in the opposite direction, and accordingly the piston member 12 is moved downward in the axial direction while being rotated. During the downward movement of the piston member 12, the steel ball 17 is moved upward so as to close the valve, as a result of which the vicous fluid contained in the chamber 23 and in the chamber 24 communicated through the serrations 11 and 13 with the chamber 23 is allowed to flow in through the through-hole 18; however, in this case the passage is throttled at the opening edge 18*a*, smaller in diameter, of the through-hole 18 by the control rod 28 inserted into the through-hole 18 provided in the central portion of the pressure control member 15, as a result of which the downward movement of the piston member 12 is resisted; that is, a damping force is applied to the door being closed. In this case, the adjustment of the damping force of the valve in the pressure control member 15, which operates as the check valve, can be achieved by adjusting the vertical position of the control rod 28 with an adjusting tool such as a screw driver which is guided by the guide bush 34, by utilizing the pressure control screw 27 after cap 35 is removed from the upper end portion of the first cylinder 1.

In FIG. 2, reference numeral 36 designates a cap placed on the lower end of the second cylinder 2, and reference character 4*a* designates steel balls in the thrust bearing 4.

As is apparent from the above description, in the damping device according to this invention, the multi-thread section is provided on the outer wall of the piston member which is moved up and down by the rotation of the piston operation member, and the cylinder with the bottom which is provided with a plurality of protruded sections shaped by pressing so as to be in correspondence to the thread grooves of the multi-thread section is fixedly provided in the cylinder, so that the rotation of the piston member around its axis and the vertical movement thereof along the axis are guided. Therefore, the process of cutting screw threads on the guide member for moving the piston member up and down can be eliminated, and moreover the additional process of welding the separate piece so as to detain the guide member at the top can be eliminated, although these processes are required by the conventional damper device as was described before. Thus, the present invention has an economical merit that the manufacture is simple and the manufacturing cost is low. Furthermore, the construction of the damper device is so designed that no oil leakage from the junctions is caused. Accordingly, the invention is effective in maintenance. In addition, according to the invention, the door closing speed can be varied as desired by changing the angle of the tapered surface of the tapered section of the control rod. Thus, the damper device according to the invention has various merits that it is high in reliability and has an excellent damping effect.

What is claimed is:

1. In a damper device comprising a first cylinder carrying a hinge piece;

a second cylinder carrying another hinge piece axially arranged with respect to said first cylinder;

a rotation support-member disposed between said first and second cylinders which are rotatable with respect to each other;

a piston operating member secured at one end to the first cylinder and extending with its other end into said second cylinder;

a piston member located in said second cylinder and engaged by said other end of said piston operating member in such a manner that the piston member is moved vertially on rotation of said first cylinder;

an upper chamber and a lower chamber formed in the second cylinder by said piston operating member and said piston member;

a pressure control member fitted on said piston member;

a check valve in said pressure control member communicating with said lower chamber;

the improvement comprising:

a cylindrical end piece located at the end of the second cylinder remote from the first cylinder;

a plurality of inwardly protruding sections formed inside said cylindrical end piece and in threaded engagement with multi-threads on the outer wall of said piston member;

a control rod axially extending the full length of said piston operating member and pressure control member;

a tapered portion on said control rod; and a pressure control screw at the end of the control rod projecting beyond the piston operating member, the arrangement being such that the dampening action of the device can be controlled by adjustment of the pressure control screw.

* * * * *